US010840603B2

(12) United States Patent
Bosshard et al.

(10) Patent No.: US 10,840,603 B2
(45) Date of Patent: Nov. 17, 2020

(54) MECHANICAL ARCHITECTURE OF A BEAM FORMER FOR SINGLE-REFLECTOR MFPB ANTENNA WITH FEED SHARING IN TWO DIMENSIONS OF SPACE AND METHOD FOR PRODUCING THE BEAM FORMER

(71) Applicant: THALES, Courbevoie (FR)

(72) Inventors: Pierre Bosshard, Toulouse (FR); Florent Lebrun, Toulouse (FR); Hélène Jochem, Toulouse (FR)

(73) Assignee: THALES, Courbevoie (FR)

( * ) Notice: Subject to any disclaimer, the term of this patent is extended or adjusted under 35 U.S.C. 154(b) by 394 days.

(21) Appl. No.: 15/849,269

(22) Filed: Dec. 20, 2017

(65) Prior Publication Data

US 2018/0183155 A1 Jun. 28, 2018

(30) Foreign Application Priority Data

Dec. 22, 2016 (FR) ..... 16 01834

(51) Int. Cl.
*H01Q 21/00* (2006.01)
*H01Q 21/06* (2006.01)
(Continued)

(52) U.S. Cl.
CPC ..... *H01Q 21/0025* (2013.01); *H01P 1/042* (2013.01); *H01P 5/024* (2013.01);
(Continued)

(58) Field of Classification Search
CPC .... H01Q 1/288; H01Q 13/0241; H01Q 19/17; H01Q 19/191; H01Q 21/0006;
(Continued)

(56) References Cited

U.S. PATENT DOCUMENTS 6,320,537 B1 * 11/2001 Chien ..... H01Q 3/26 342/361
2007/0252759 A1 * 11/2007 Brunasso ..... H01Q 21/064 342/383
2016/0315391 A1 10/2016 Bosshard et al.

FOREIGN PATENT DOCUMENTS

EP 2 930 790 A1 10/2015
FR 2 993 716 A1 1/2014
(Continued)

OTHER PUBLICATIONS

Q. Lai et al., "A prototype of feed subsystem for a multiple-beam array-fed reflector antenna," 2015 IEEE International Symposium on Antennas and Propagation & USNC/URSI National Radio Science Meeting, Jul. 19, 2015, pp. 238-239, XP032796220.
(Continued)

*Primary Examiner* — Robert Karacsony
(74) *Attorney, Agent, or Firm* — BakerHostetler

(57) ABSTRACT

A mechanical architecture of a beam former comprises a plurality of elementary combination circuits and a support structure, the elementary combination circuits being independent of one another, each elementary combination circuit intended to form a beam, the support structure comprising two metal interface plates, respectively top and bottom, the two interface plates formed parallel to one another and spaced apart from one another, in a heightwise direction Z orthogonal to the two interface plates, the elementary combination circuits mounted in the space between the two interface plates and fixed at right angles to the two interface plates.

12 Claims, 7 Drawing Sheets

(51) Int. Cl.

| | |
|---|---|
| ***H01Q 25/00*** | (2006.01) |
| ***H01Q 19/17*** | (2006.01) |
| ***H01P 5/02*** | (2006.01) |
| ***H01P 1/04*** | (2006.01) |
| ***H01P 11/00*** | (2006.01) |
| ***H01Q 1/28*** | (2006.01) |
| ***H01P 5/19*** | (2006.01) |
| ***H01Q 21/24*** | (2006.01) |

(52) U.S. Cl.
CPC ..... *H01P 11/002* (2013.01); *H01Q 19/17* (2013.01); *H01Q 21/064* (2013.01); *H01Q 25/007* (2013.01); *H01P 5/19* (2013.01); *H01Q 1/288* (2013.01); *H01Q 21/24* (2013.01)

(58) Field of Classification Search
CPC .. H01Q 21/0025; H01Q 21/064; H01Q 21/24; H01Q 25/007; H01P 1/042; H01P 5/12; H01P 5/024; H01P 5/19; H01P 11/002
See application file for complete search history.

(56) References Cited

FOREIGN PATENT DOCUMENTS

| | | | |
|---|---|---|---|
| JP | 2010-200144 | A | 9/2010 |
| WO | 2007/130316 | A2 | 11/2007 |

OTHER PUBLICATIONS

B. Zhang et al., "Metallic 3D Printed Rectangular Waveguides for Millimeter-Wave Applications," IEEE Transactions on Components, Packaging and Manufacturing Technology, vol. 6, No. 5, May 1, 2016, pp. 796-804, XP011610475.

* cited by examiner

MECHANICAL ARCHITECTURE OF A BEAM FORMER FOR SINGLE-REFLECTOR MFPB ANTENNA WITH FEED SHARING IN TWO DIMENSIONS OF SPACE AND METHOD FOR PRODUCING THE BEAM FORMER

CROSS-REFERENCE TO RELATED APPLICATIONS

This application claims priority to foreign French patent application No. FR 1601834, filed on Dec. 22, 2016, the disclosure of which is incorporated by reference in its entirety.

FIELD OF THE INVENTION

The present invention relates to a mechanical architecture of a beam former for single-reflector MFPB antenna with feed sharing in two dimensions of space and a method for producing the beam former. It applies to the multiple-beam antennas with feed sharing in which each beam is formed by four feeds.

BACKGROUND

In an MFPB (multiple feeds per beam) antenna with several radiofrequency RF feeds per beam, each beam is formed by combining the ports of several radiofrequency sources of a focal array, each radiofrequency feed consisting of a radiating element connected to a transmission and reception radiofrequency chain generally with two ports. For that, the RF feeds of the focal array are grouped together in a plurality of elementary cells comprising the same number of RF feeds and forming a grid. Depending on the layout of the radiofrequency feeds in the focal array and the number of radiofrequency feeds in each mesh, the mesh can have different geometrical forms, for example square or hexagonal. The ports of the radiofrequency feeds of each mesh can then be combined with one another to form beams. To obtain good overlap between the beams, it is known practice to reuse one or more radiofrequency feeds to form adjacent beams. When the reuse of the radiofrequency feeds is performed in two dimensions of space, that conventionally necessitates the use of a complex beam-forming network BFN, which comprises axially arranged power combination circuits, which intersect with one another, and it is then impossible to physically separate the combination circuits dedicated to the formation of different beams. This difficulty is increased by the use of couplers common to several radiofrequency feeds, which allow the reuse of the radiofrequency feeds and the mutual independence of the beams. The manufacturing and assembly of these antennas is very complex and the number of beams which can be formed is limited when the functional elements, such as the BFN, cannot be subdivided into subassemblies in a modular approach.

The document FR 2 993 716 describes a transmission and reception MFPB antenna architecture comprising a focal array equipped with four-port compact radiofrequency feeds, in which each beam is generated by combining, in fours, the ports of the same polarization and of the same frequency of a group of four radiofrequency feeds of the array. This antenna works in transmission and in reception, and two adjacent beams operating in orthogonal polarizations are generated by two different groups of RF feeds, each consisting of four radiofrequency feeds that can share one or two radiofrequency feeds, depending on the arrangement of the four RF feeds in the mesh. An example of modular layout of the RF feeds and of the BFNs in the focal array is described in the document FR 3035548. In this layout, the combination circuits dedicated to each row of four RF feeds are grouped together in a partial linear BFN, the partial BFNs being manufactured in half-shells in which are machined the waveguides forming the combination circuits, then the half-shells are assembled together and stacked to form a multilayer structure. This layout is very compact, but this layout makes it possible to reuse the radiofrequency feeds only in one dimension of space, which requires the use of a second identical antenna to obtain a good overlapping of the beams in the two dimensions of space.

The authors Qinghua et al (Lai Qinghua et al., "A prototype of feed subsystem for a multiple-beam array-fed reflector antenna", IEEE International symposium on antennas and propagation, 2015) present a supply system for a reflective antenna with multiple beams and with feeder array, comprising several circularly polarized horn antennas, a matrix of RF switches, a digital control panel and a voltage converter panel. The feeds to the antennas are divided into four groups, just like the matrix of RF switches. Each branch of the matrix takes control of the horn antennas belonging to one and the same feed group and, at each instant, each branch of the matrix selects a horn antenna to deliver signals to the RF signal processing circuits.

The document WO 2007/130316 discloses a beam-forming system comprising a set of input and output couplers. An adapter is placed between the input couplers and the output couplers.

The document EP 2930790 presents an array of antennas comprising a single array feeding the radiating elements.

The authors Zhang Bing et al (Zhang Bing et al., "Metallic 3-D printed rectangular waveguides for millimeter-wave applications", IEEE Transactions on components, packaging and manufacturing technology, 6: 796-804, 2016) demonstrate the feasibility of manufacturing, by 3D printing, the rectangular waveguides used in millimetric wave applications.

SUMMARY OF THE INVENTION

The aim of the invention is to remedy the problems of the known MFPB antennas and to produce a novel mechanical architecture of a beam former for an antenna with feed sharing and a novel method for producing a beam former, the beam former having a dimension that can be adjusted according to the requirements, without limitation, and allowing the generation of the beams in two dimensions of space with a good overlap between two adjacent beams by using a single single-reflector MFPB antenna.

For that, the invention relates to a mechanical architecture of a beam former for a single-reflector MFPB antenna with feed sharing in two dimensions of space, in which the beam former comprises a plurality of elementary combination circuits and a support structure, the elementary combination circuits being independent of one another, each elementary combination circuit being intended to form a beam. The support structure comprises two metal interface plates, respectively top and bottom, the two interface plates being formed parallel to one another and spaced apart from one another, in a direction Z orthogonal to the two interface plates, the elementary combination circuits being mounted in the space between the two interface plates and fixed at right angles to the two interface plates.

Advantageously, each elementary combination circuit can have a single-piece candlestick structure, each candlestick comprising a bottom access waveguide, at least four top access waveguides, and intermediate link waveguides linking the top access waveguides to the bottom access waveguide.

Advantageously, the two interface plates, respectively top and bottom, comprise a plurality of through orifices, the bottom access waveguide of each elementary combination circuit is linked to a corresponding through orifice of the bottom interface plate and the at least four top access waveguides of each elementary combination circuit are respectively linked to corresponding through orifices of the top interface plate.

Advantageously, the link between the bottom access waveguide of each elementary combination circuit and a corresponding through orifice of the bottom interface plate is a contactless junction.

Advantageously, the contactless junction can consist of a connecting flange comprising a male part secured to the bottom access waveguide and a female part consisting of a ring, the ring being mounted, leaving a gap remaining, around the male part of the connecting flange, the inner surface of the ring, and/or the outer surface of the male part of the connecting flange, being provided with evenly distributed metal studs.

Advantageously, the ring can be fixed inside the through orifice of the bottom interface plate.

Advantageously, the ring can be fixed to the male part of the connecting flange by a clip device.

Advantageously, all the elementary combination circuits can be formed parallel to one another between the two interface plates, respectively top and bottom.

The invention relates also to a single-reflector MFPB antenna with feed sharing in two dimensions of space comprising such a mechanical architecture.

The invention relates also to a method for producing a beam former for an antenna with feed sharing in two dimensions of space, consisting:

in manufacturing a plurality of elementary combination circuits, each elementary combination circuit having the form of a candlestick comprising a bottom access waveguide and at least four top access waveguides linked to the bottom access waveguide, then in manufacturing a support structure comprising two metal interface plates, the manufacturing comprising steps consisting in machining respective through orifices in the two metal interface plates and in mounting the two metal interface plates parallel to one another and leaving a space remaining in a direction Z orthogonal to the two interface plates, then in mounting and fixing all the elementary combination circuits parallel to one another in the space between the two interface plates, the top and bottom access waveguides of each elementary combination circuit being respectively linked to the corresponding through orifices formed in the two interface plates.

Advantageously, each elementary combination circuit can be produced individually by an additive manufacturing method consisting in adding successive layers of material, stacked one on top of the other.

Advantageously, the additive manufacturing method can be chosen from the laser stereolithography methods or the three-dimensional printing methods.

Advantageously, the method can further comprise a step of individual encapsulation of each elementary combination circuit in a metal cap.

BRIEF DESCRIPTION OF THE DRAWINGS

Other features and advantages of the invention will become clearly apparent from the rest of the description given solely by way of illustrative and non-limiting example, referring to the attached schematic drawings which represent.

DETAILED DESCRIPTION

As a nonlimiting example, the rest of the description is based on examples of combination circuits linking ports of four RF feeds, but the invention applies equally to combination circuits linking ports of a number of RF feeds greater than four.

Figure 1:
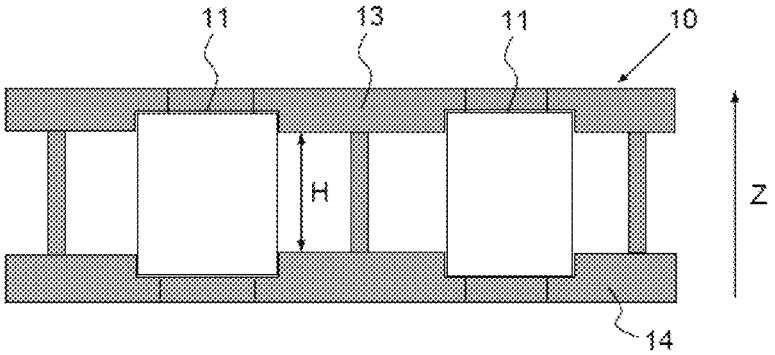
FIG. 1: a block diagram, in cross section, of an example of mechanical architecture of a beam former, according to the invention.
Figure 2:
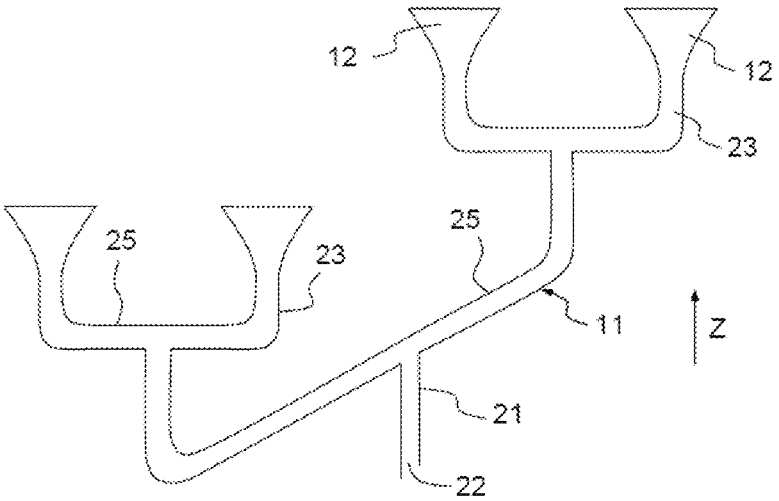
FIG. 2: a diagram illustrating an example of combination circuit linking four ports of four RF feeds, according to the invention.

The mechanical architecture of the beam former represented in FIG. 1 comprises a plurality of elementary combination circuits 11 and a mechanical support structure 10, the elementary combination circuits 11 being independent of one another. In this nonlimiting example, each elementary combination circuit 11 is dedicated to combining ports of four RF feeds 12 to form a beam, as represented for example in the diagram of FIG. 2, which illustrates a combination circuit linked to a group of four RF feeds, each RF feed being composed of several radiofrequency chains performing transmission and reception functions in two orthogonal polarizations and a radiating element, for example of horn type, linked to the RF chains. By using four-port RF feeds, a single transmission port and a single reception port of each RF feed of a group of four RF feeds are used to form a transmission beam and, respectively, a reception beam. The two other ports of each RF feed are then available and each RF feed can be re-used twice to form two additional beams. The support structure 10 comprises two metal interface plates 13, 14, respectively top and bottom, the two interface plates being formed parallel to one another and spaced apart from one another by a distance H in a direction Z orthogonal to the plane of the interface plates. The elementary combination circuits 11 are mounted alongside one another, at right angles to the interface plates, in the space between the two interface plates 13, 14 and are fixed to the two interface plates. This mechanical architecture described explicitly for the production of a beam former can also be used to produce the RF chains of the different RF feeds of the antenna. It is then sufficient to replace the combination circuits with the RF chains which are then arranged between two metal interface plates of a corresponding support structure. Similarly, this mechanical architecture described explicitly for combination circuits linking the ports of four RF feeds can also be used for combination circuits linking the ports of a number of RF feeds greater than four.

Figure 3A:
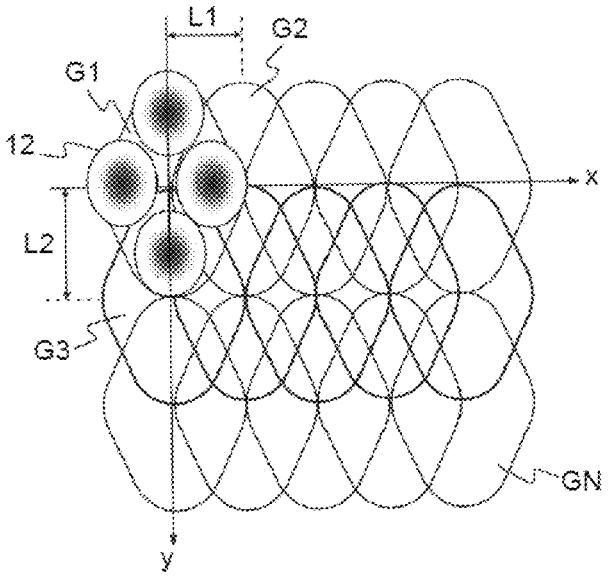
FIG. 3*a*: a partial diagram illustrating an example of configuration of an array of RF feeds of an MFPB antenna with hexagonal mesh and of its four-source groupings, according to the invention.

FIG. 3*a* illustrates an example of configuration of an array of RF feeds whose radiating elements are distributed according to a hexagonal mesh. The beams are formed by several groupings of four RF feeds whose ports of the same frequency and of the same polarization are interconnected with one another. In this FIG. 3*a*, N groups G1, G2, G3, . . . , GN are represented, but, to simplify FIG. 3*a*, the RF feeds 12 are only represented in the group G1. The different groupings of four feeds are offset relative to one another in the directions X and Y of the plane of the array of RF feeds.

Figure 3B:
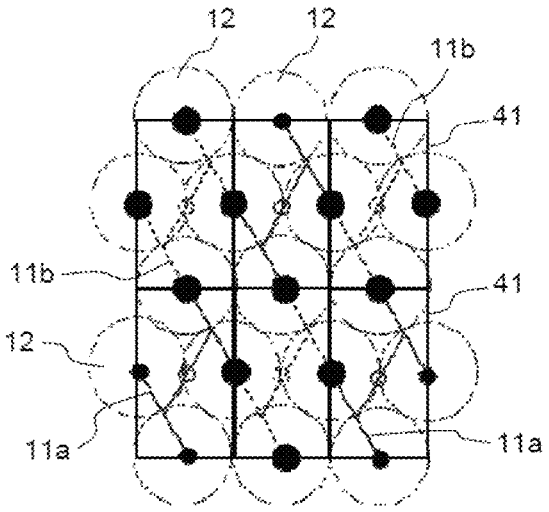
FIG. 3*b*: a diagram illustrating an example of connections between the ports of the RF feeds of different four-source groupings, allowing a rectangular mesh coverage to be formed, according to the invention.

FIG. 3*b* illustrates an example of interconnections between the ports operating at one and the same first frequency F1, for different groupings of four RF feeds, making it possible to obtain a multiple-spot coverage with rectangular mesh. In this configuration, the multiple-beam transmission and reception antenna system comprises a single single-reflector antenna with several feeds per MFPB (multiple feeds per beam) beam, the antenna operating both in transmission and in reception. The antenna comprises a single reflector and an array of several RF feeds illuminating the reflector, the RF feeds being distributed according to a hexagonal or square array mesh and associated in several groups offset relative to one another in directions X and Y of a plane. Each RF feed comprises two transmission ports and two reception ports. The two transmission ports operate at one and the same transmission frequency F1 and in respective different polarizations P1, P2 orthogonal to one another, and the two reception ports operate at one and the same reception frequency F2 and in respective polarizations P1, P2 orthogonal to one another. The RF feeds are associated in groups of four adjacent RF feeds in directions X and Y of the array of RF feeds. For each group of four adjacent RF feeds, the first transmission ports corresponding to one and the same frequency and polarization value pair, for example the value pair (F1, P1), or the value pair (F1, P2), are linked to one another, the four transmission ports linked to one another forming a transmission beam. Similarly, four reception ports of each of the four RF feeds 12 of said group of four adjacent RF feeds 12, corresponding to one and the same frequency and polarization value pair, for example the value pair (F2, P1), or the value pair (F2, P2), are linked to one another, the four reception ports linked to one another forming a reception beam. Each RF feed of said group therefore also comprises a transmission port and a reception port available to form a second transmission beam and, respectively, a second reception beam, together with two other groups of four adjacent RF feeds in the direction X and respectively in the direction Y.

For the forming of each beam, the links between the transmission, or reception, ports of a group of four RF feeds 12 are produced by combination circuits 11*a*, 11*b*, the combination circuits 11*a*, 11*b* dedicated to forming different beams being independent of one another. The array of RF feeds, the reflector and the combination circuits are configured, in terms of geometry and of connectivity, so as to form a total coverage of the service zone by spots 41 distributed according to a mesh of rectangular coverage. In FIG. 3*b*, the combination circuits 11 a represented by solid lines correspond to the frequency F1 and a first polarization P1, the combination circuits 11*b* represented by dotted lines correspond to the frequency F1 and a second polarization P2. The big black dots correspond to the two ports of the RF feeds 12 operating respectively in the polarizations P1 and P2, the small black dots correspond to a port of the RF feeds 12 operating in the polarization P1 or in the polarization P2. The small circles represented by solid lines or by dotted lines are output ports for the beams of respective polarization P1 or P2. Obviously, similar interconnections also have to be produced for the ports for the RF feeds 12 operating at the frequency F2.

The mesh of the array of RF feeds is a hexagonal mesh and the radiant aperture of the radiating element of each RF feed has a circular form. Two consecutive adjacent groups G1, G2 in the direction X are spaced apart by a first pitch L1 corresponding to an RF feed in the direction X and share a common RF feed; two consecutive adjacent groups G1, G3 in the direction Y are spaced apart by a second pitch L2 corresponding to an RF feed in the direction Y and share a common RF feed. Each group of four RF feeds forms a transmission beam and a reception beam whose imprints on the ground, called spots, are of substantially rectangular forms.

This configuration is particularly compact because the antenna architecture comprises only a single reflector to produce all of the multiple-beam coverage both in transmission and in reception. The beam former is made up of all of the combination circuits respectively dedicated to forming each transmission and reception beam by the combination of the RF feeds in groups of four and in the two dimensions X and Y of the array of RF feeds. Each rectangular spot illuminating the coverage zone results from the combination of four ports of a group of four adjacent RF feeds.

Figure 4A:
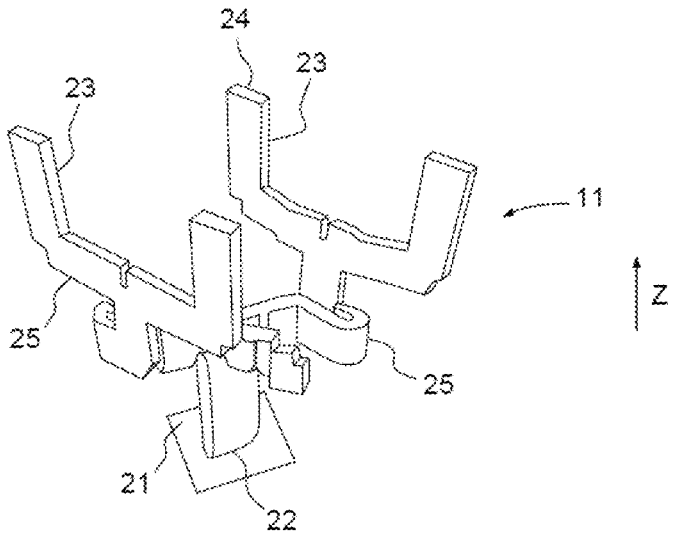
FIGS. 4*a* and 4*b*: two diagrams respectively illustrating a first example of elementary combination circuit dedicated to reception and a second example of elementary combination circuit dedicated to transmission, according to the invention.
Figure 4B:
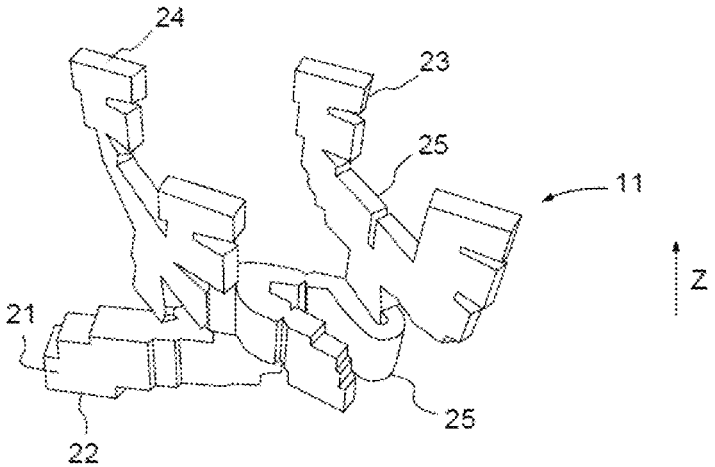
Figure 6:
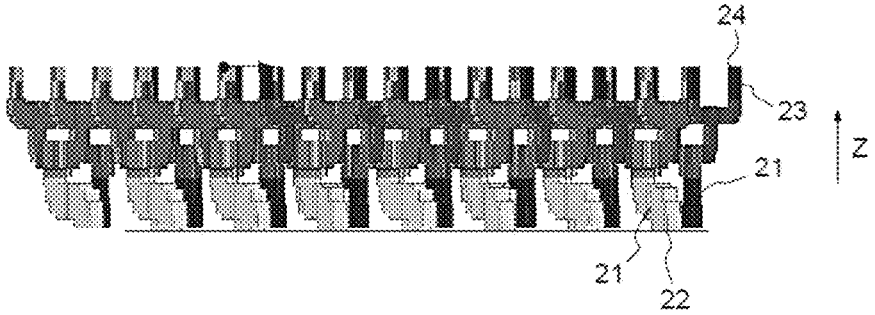
FIG. 6: a mounting diagram illustrating a row of several elementary combination circuits formed alongside one another, according to the invention.

As illustrated in the diagram of FIG. 4*a* which represents an example of elementary combination circuit dedicated to reception, and in the diagram of FIG. 4*b* which represents an example of elementary combination circuit dedicated to transmission, each elementary combination circuit 11 has a one-piece candlestick structure. Each candlestick consists, in the heightwise direction, in the direction Z, of a bottom leg 21 formed by a bottom waveguide 21 provided with a bottom access orifice 22 and at least four top arms respectively formed by top waveguides 23 provided with respective top access orifices 24, visible in FIG. 6, the at least four top waveguides being linked to the bottom waveguide by intermediate link waveguides 25. The elementary combination circuits dedicated to transmission and the elementary combination circuits dedicated to reception are of similar forms but have different waveguide dimensions to adapt them to the respective operating frequency bands. When the frequency band is lower in transmission than in reception, the waveguides of the combination circuits dedicated to transmission are of larger dimensions than in reception. Since the candlesticks are mounted in the heightwise direction, between the two interface plates 13, 14, the waveguides with the largest dimensions can be bent so that the height of all of the candlesticks is identical in transmission and in reception. For the elementary combination circuits dedicated to transmission, the bottom access orifice is an RF input port and the top access orifices are RF output ports intended to be respectively linked to respective RF feeds. For the combination circuits dedicated to reception, the input and output ports are reversed, the top access orifices being RF input ports intended to be linked to respective RF feeds and the bottom access orifice being an RF output port.

Figure 5:
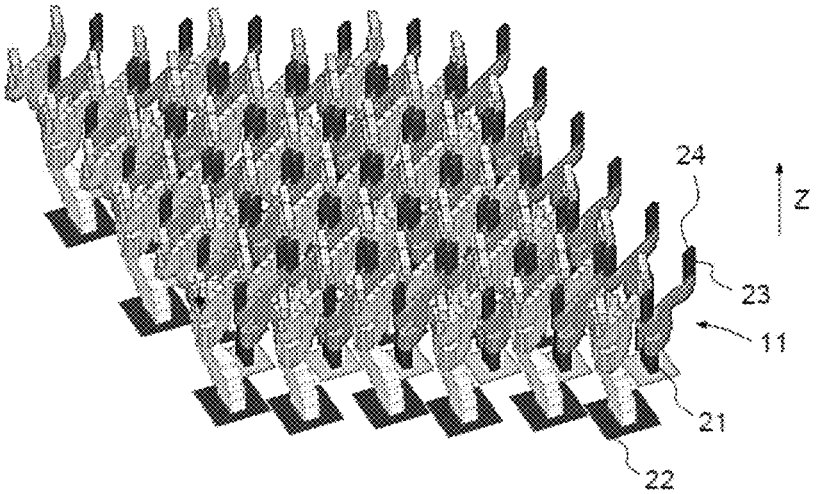
FIG. 5: a diagram illustrating an assembly of several elementary combination circuits formed alongside one another in two dimensions of space and mounted parallel to one another, according to the invention.
Figure 7:
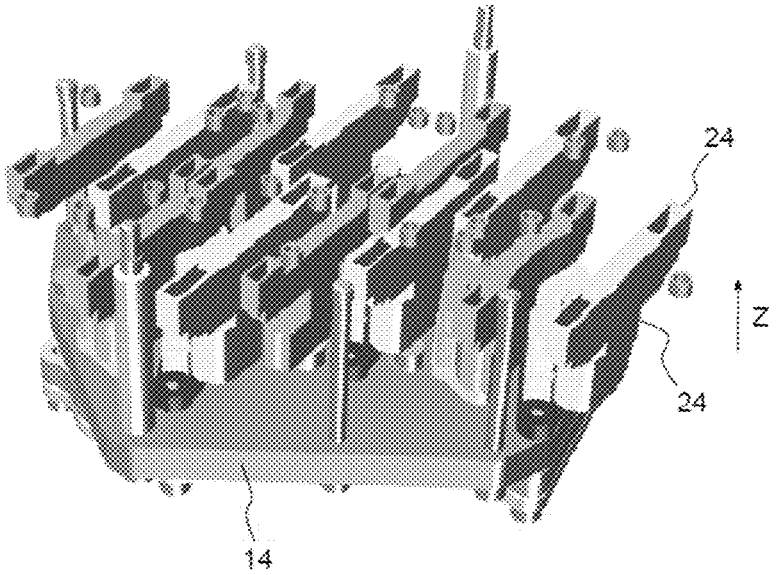
FIG. 7: a diagram illustrating, seen from above, an assembly of several elementary combination circuits formed alongside one another and fixed onto a bottom interface plate, the top interface plate being omitted, according to the invention.

As represented in the exemplary layout of FIG. 5 in which the two interface plates have been removed, between the two interface plates, the elementary combination circuits 11 dedicated to transmission and to reception are mounted alongside one another, in the space between the two interface plates, and are evenly distributed in a plane parallel to the plane of the interface plates. The elementary combination circuits 11 extend heightwise in a direction Z orthogonal to the interface plates, and are all oriented parallel to one another between the two interface plates, respectively bottom and top. The elementary combination circuits dedicated to transmission are inserted between elementary combination circuits dedicated to reception as shown by the assemblies represented in FIGS. 6 and 7 in which the top plate has been removed.

Figure 8:
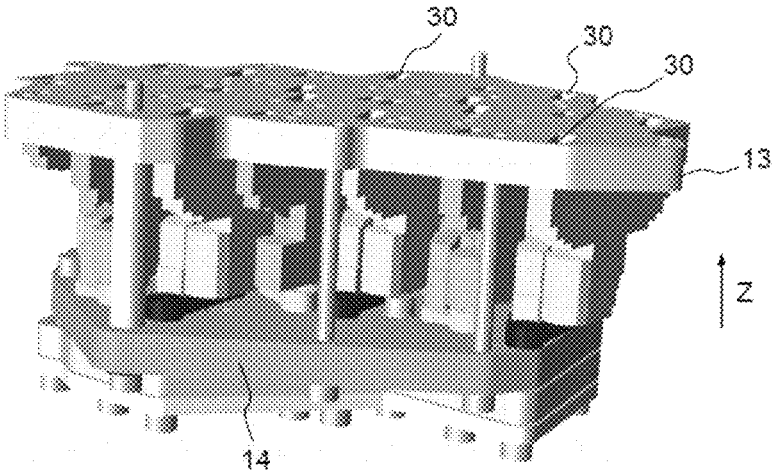
FIG. 8: a diagram illustrating, seen from above, an assembly of several elementary combination circuits formed alongside one another between two interface plates, according to the invention.
Figure 9A:
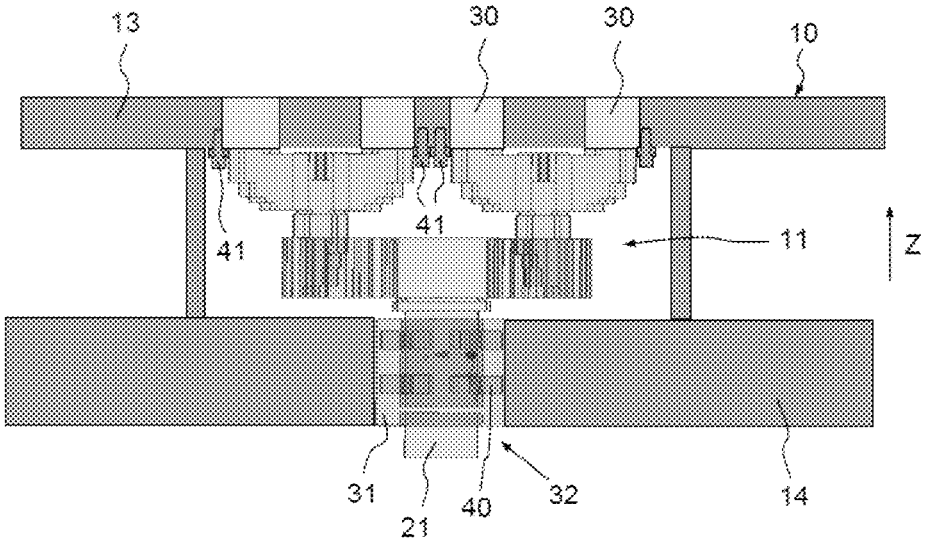
FIG. 9*a*: a partial diagram in transverse cross section illustrating an elementary combination circuit formed between two interface plates and provided with a first example of contactless junction comprising a connecting flange with symmetry of revolution, according to the invention.

The two interface plates 13, 14, respectively top and bottom, comprise a plurality of through orifices 30, 31 as shown by the top interface plate 13 of the assembly illustrated in FIG. 8 and the cross-sectional view of FIG. 9*a*. The bottom waveguide 21 of each elementary combination circuit 11 is linked to a through orifice 31 of the bottom interface plate 14 and the four top waveguides 23 of each elementary combination circuit 11 are respectively linked to four corresponding through orifices 30 of the top interface plate 13. The bottom waveguide 21 is intended to be connected to an electrical cable assembly. The top waveguides 23 are intended to be connected to the RF chains of the different RF feeds of the array of RF feeds.

Figure 9B:
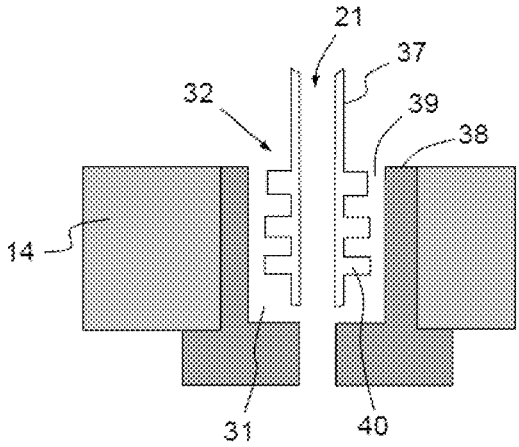
FIGS. 9*b* and 9*c*: detail views in transverse cross section, illustrating two examples of fixing of a contactless junction with symmetry of revolution, according to the invention.
Figure 9C:
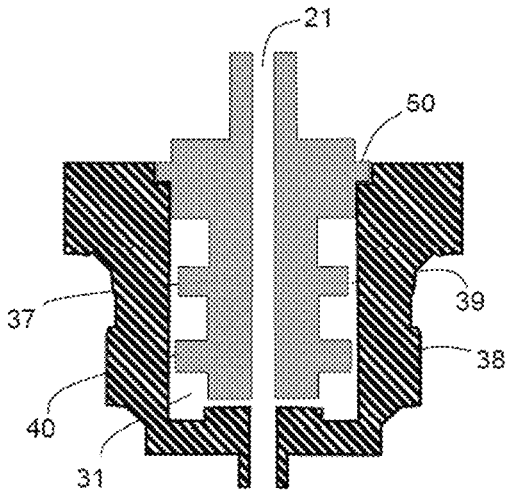

As illustrated in FIG. 9*a*, the links between the bottom waveguide 21 of each elementary combination circuit 11 and the respective through orifice 31 can consist of contactless junctions 32. A contactless junction in particular makes it possible to manage the differential lengths which can exist between the different elementary combination circuits 11 and also makes it possible, in the case where the assembly of the elementary combination circuits is performed on a structural panel of the antenna, to completely decouple the elementary combination circuits 11 from the bottom interface plate 14. However, it is not possible to use a conventional planar contactless junction because the space available for forming the contactless junction is limited by the dimensions of the center distance between the bottom waveguides of two consecutive elementary combination circuits, said center distance being imposed by the dimensions of the mesh of the array of RF feeds. Consequently, to ensure the links between the bottom access waveguide 21 of each elementary combination circuit 11 and the respective through orifice 31, according to the invention, as represented in the transverse cross-sectional view of FIG. 9*a* and in the exemplary embodiments illustrated in the detail views of FIGS. 9*b* and 9*c*, each contactless junction 32 between a bottom access waveguide 21 of each elementary combination circuit 11 and a respective through orifice 31 consists of a connecting flange comprising two connection parts 37, 38, respectively male and female, with symmetry of revolution, cooperating with one another without contact. The male part 37 is secured to the bottom access waveguide 21, the female part consists of a ring 38 fixed inside the through orifice 31 of the bottom interface plate 14. The ring 38 is mounted, leaving a gap 39 remaining, around the male part 37 of the connecting flange. The inner surface of the ring 38, and/or the outer surface of the male part 37 of the connecting flange, is provided with evenly distributed metal studs 40. The ring 38 can be fixed to the male part of the connecting flange by any known fixing means and in particular by a clip device 50 as represented in the exemplary embodiment of FIG. 9*c*.

Figure 10:
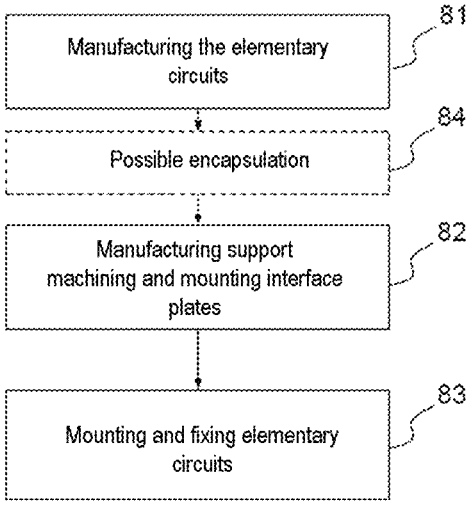
FIG. 10: an overview diagram of an example of a method for manufacturing a beam former, according to the invention.

The beam former can be manufactured by any conventional method such as, for example, by machining and assembling a set of several combination circuits in the form of metal half-shells stacked one on top of the other. However, to limit the manufacturing time and cost, the beam former can preferably be manufactured in accordance with the novel method described hereinbelow and illustrated in FIG. 10. This novel method consists, in a first step 81, in individually manufacturing each elementary combination circuit 11 by using an additive manufacturing method consisting, for each elementary combination circuit 11, in adding successive layers of material, stacked one on top of the other. For example, the additive manufacturing method can be chosen from the laser stereo lithography methods or the three-dimensional printing methods.

Then, in a second step 82, the method consists in manufacturing a support and interface structure comprising two metal interface plates 13, 14, the support and interface structure being able to hold and secure all the elementary combination circuits 11 to obtain a beam-forming array. The interface structure must also be able to interface each elementary combination circuit 11 with the ports of a group of four RF feeds. For that, the method according to the invention consists in machining respective through orifices 30, 31 in the two metal interface plates 13, 14, then in mounting the two metal interface plates parallel to one another leaving a heightwise space H remaining, the two interface plates being able to be held in a metal frame manufactured by machining.

Finally, in a third step 83, the method consists in mounting and fixing all the elementary combination circuits parallel to one another in the space between the two interface plates, by any known fixing means, for example by screws 41 (visible in FIG. 9*a*), the bottom and top access waveguides of each elementary combination circuit being respectively linked to the corresponding through orifices formed in the two interface plates.

Before fixing, to reinforce the mechanical solidity of each elementary combination circuit, the method can comprise an additional step 84 of individual encapsulation of each elementary combination circuit in an individual metal cap.

Although the invention has been described in relation to particular embodiments, it is obvious that it is in no way limited thereto. In particular, the number of the ports of the RF feeds linked by the combination circuits is not limited to four, but the invention applies equally to combination circuits linking ports of a number of RF feeds greater than four.

In this case, the number of top access waveguides of each combination circuit is greater than four.

The invention claimed is:

1. A mechanical architecture of a beam former for a single-reflector MFPB antenna with feed sharing in two dimensions of space, wherein the beam former comprises a plurality of elementary combination circuits and a support structure, the elementary combination circuits being independent of one another, each elementary combination circuit configured to form a beam, the support structure comprising two metal interface plates, respectively top and bottom, the two interface plates being formed parallel to one another and spaced apart from one another, in a direction Z orthogonal to the two interface plates, the elementary combination circuits being mounted in the space between the two interface plates and fixed at right angles to the two interface plates, and wherein each elementary combination circuit has a single-piece candlestick structure, each candlestick comprising a bottom access waveguide, at least four top access waveguides, and intermediate link waveguides linking the top access waveguides to the bottom access waveguide.

2. The mechanical architecture of a beam former as claimed in claim 1, wherein the two interface plates, respectively top and bottom, comprise a plurality of through orifices, and wherein the bottom access waveguide of each elementary combination circuit is linked to a corresponding through orifice of the bottom interface plate and the at least four top access waveguides of each elementary combination circuit are respectively linked to corresponding through orifices of the top interface plate.

3. The mechanical architecture of a beam former as claimed in claim 2, wherein the link between the bottom access waveguide of each elementary combination circuit and a corresponding through orifice of the bottom interface plate is a contactless junction.

4. The mechanical architecture of a beam former as claimed in claim 3, wherein the contactless junction comprises a connecting flange comprising a male part secured to the bottom access waveguide and a female part comprising a ring, the ring being mounted, leaving a gap remaining, around the male part of the connecting flange, the inner surface of the ring, and/or the outer surface of the male part of the connecting flange, being provided with evenly distributed metal studs.

5. The mechanical architecture of a beam former as claimed in claim 4, wherein the ring is fixed inside the through orifice of the bottom interface plate.

6. The mechanical architecture of a beam former as claimed in claim 5, wherein the ring is fixed to the male part of the connecting flange by a clip device.

7. The mechanical architecture of a beam former as claimed in claim 1, wherein all the elementary combination circuits are formed parallel to one another between the two interface plates, respectively top and bottom.

8. A single-reflector MFPB antenna with feed sharing in two dimensions of space, wherein said antenna comprises a mechanical architecture as claimed in claim 1.

9. A method for producing a beam former for an antenna with feed sharing in two dimensions of space comprising: in manufacturing a plurality of elementary combination circuits, each elementary combination circuit having the form of a single-piece candlestick, each candlestick comprising a bottom access waveguide, at least four top access waveguides, and intermediate link waveguides linking the top access waveguides to the bottom access waveguide, then in manufacturing a support structure comprising two metal interface plates, the manufacturing comprising steps of machining respective through orifices in the two metal interface plates and of mounting the two metal interface plates parallel to one another and leaving a space remaining in a direction Z orthogonal to the two interface plates, then mounting and fixing all the elementary combination circuits parallel to one another in the space between the two interface plates, the top and bottom access waveguides of each elementary combination circuit being respectively linked to the corresponding through orifices formed in the two interface plates.

10. The method for producing a beam former as claimed in claim 9, wherein each elementary combination circuit is produced individually by an additive manufacturing method consisting in adding successive layers of material, stacked one on top of the other.

11. The method for producing a beam former as claimed in claim 10, wherein the additive manufacturing method is chosen from the laser stereolithography methods or the three-dimensional printing methods.

12. The method for producing a beam former as claimed in claim 9, wherein it further comprises a step of individual encapsulation of each elementary combination circuit in a metal cap.

* * * * *